United States Patent [19]

Tanahashi et al.

[11] 4,411,845

[45] Oct. 25, 1983

[54] THROTTLE VALVE ASSEMBLY

[75] Inventors: Toshio Tanahashi, Toyota; Sinya Sumitani, Kariya; Takeo Matuura, Kariya; Shinji Ichikawa, Kariya; Takao Okuno, Toyota, all of Japan

[73] Assignees: Nippondenso Co., Ltd., Kariya; Toyota Jidosha Kogyo Kabushiki Kaisha, Toyota, both of Japan

[21] Appl. No.: 381,509

[22] Filed: May 24, 1982

[30] Foreign Application Priority Data

May 30, 1981 [JP] Japan ..... 56-81836

[51] Int. Cl.[3] ..... F02M 19/12

[52] U.S. Cl. ..... 261/65; 251/238; 74/513; 74/516; 74/526

[58] Field of Search ..... 261/65; 251/238; 74/513, 516, 526

[56] References Cited

U.S. PATENT DOCUMENTS

| | | | |
|---|---|---|---|
| 1,612,162 | 12/1926 | Thomas | 74/526 |
| 2,385,881 | 10/1945 | Peterson | 74/516 |
| 2,807,692 | 9/1957 | Leslie | 74/526 |
| 2,869,393 | 1/1959 | Hutchison | 74/513 |
| 3,116,906 | 1/1964 | Callahan | 261/65 |
| 3,341,185 | 9/1967 | Kennedy, Sr. | 261/65 |

FOREIGN PATENT DOCUMENTS

| | | | |
|---|---|---|---|
| 55-35142 | 12/1980 | Japan | 261/65 |

*Primary Examiner*—Tim R. Miles

*Attorney, Agent, or Firm*—Cushman, Darby & Cushman

[57] ABSTRACT

An improved throttle valve assembly of the type which includes a throttle body provided with a throttle lever and a second, intermediate lever interconnected with each other by a roller/cam slot mechanism, said throttle lever being adapted to be moved by said second lever which is connected through the throttle linkage to the accelerator. The improvement comprises means disposed between the throttle lever and the second lever for adjusting the clearance existing between the cam slot and roller when the throttle valve is located in the vicinity of the idle position thereof, so that the excessive play that would otherwise arise at the accelerator when the throttle valve is in the idle position is reduced or avoided.

8 Claims, 4 Drawing Figures

THROTTLE VALVE ASSEMBLY

BACKGROUND OF THE INVENTION

This invention relates to a throttle valve assembly for controlling the output power of an internal-combustion engine and, more particularly, to such a throttle valve assembly of the type which includes a throttle body having an intake passage therein, a throttle shaft journalled on said throttle body across said intake passage, a throttle lever secured to said throttle shaft, a throttle valve mounted on said throttle shaft for regulating the flow rate of the intake air flowing through said intake passage, and a second, intermediate lever pivoted on said throttle body and adapted to be moved via a throttle linkage by an accelerator, one of said throttle lever and second lever having an arcuated cam slot engaging a roller mounted rotatably on the other lever for interconnecting said levers with each other, and wherein the cam profile of said cam slot is arranged so that when the accelerator pedal is stepped on, the angular position of the throttle valve varies in response to the travel of the accelerator according to a predetermined functional relationship.

A throttle valve assembly of the type described is known in the prior art. This throttle valve assembly enables the throttle valve to move according to a preselected functional relationship with respect to the travel of the accelerator of the vehicle and thus ensures the acceleration of the vehicle in accordance with the driver's wishes. This type of throttle valve assembly is, thus, advantageous over other conventional throttle valve assemblies in which the travel of the accelerator is transferred through a throttle linkage to a throttle lever/shaft assembly without the interposition of an intermediate lever and, therefore, the angular displacement of the throttle valve is proportional to the travel of the accelerator.

In the throttle valve assembly of the type described, however, it has been customary to make the width of the cam slot, formed in one of two levers, larger than the outer diameter of the assocaited roller, in consideration of the dimensional variations that result during machining of the cam slot. As a result, a crosswise clearance is formed between the cam slot and the roller in a direction perpendicular to the axis of the cam slot. Also, for similar reasons in respect to the manufacturing technique, the length of the cam slot as measured along the axis thereof is made greater than the maximum travel of the roller which takes place as the throttle valve undergoes angular displacement from the closed or idle position to a wide-open position. As a result, a considerable lengthwise clearance is also formed between the roller and the proximal end of the cam slot when the throttle valve is in the idle position. These crosswise and lengthwise clearances result in an excessive play in the accelerator, which, in turn, causes the driver discomfort.

Further, in the prior throttle valve assembly of the type described, both the throttle lever and the intermediate lever are provided with a return spring so that the throttle shaft, and hence the throttle valve, is returned to the idle position by the sum of the spring forces of these two springs. With this arrangement, when the accelerator is released so as to decelerate the vehicle, both the throttle lever and the intermediate lever effect a return swing, due to the action of the two springs, until the return swing motion of the intermediate lever is completed. After termination of the return swing of the intermediate lever, however, the throttle lever must be moved back to the idle or rest position through the above-mentioned lengthwise clearance by only the single return spring associated therewith. This causes the return swing of the throttle valve through said lengthwise clearance to be performed inadequately and gives rise to an unnecessary play in the throttle linkage or the accelerator.

Still further, the prior throttle valve assembly uses a roller which is in the form of a hollow cylinder and is made from a single mass of material, the roller being mounted rotatably on a roller shaft. With such a roller, the friction existing between the outer surface of the roller and the cam slot differs from that existing between the inner surface of the roller and the roller shaft, so that when the friction at the inner surface is greater than the friction at the outer surface, smooth rotation of the roller is hindered, thereby increasing wearing of the cam slot. Moreover, as the outer surface of the roller is cylindrical, the outer surface comes into contact edgeways with the edge of the cam slot when the axis of the roller is inclined with respect to the lever which is provided with the cam slot, thereby resulting in abnormal wearing of the cam slot.

Another disadvantage of the prior throttle valve assembly is that an excessive force is applied to the roller/cam slot mechanism when the accelerator is pressed all the way down, such excessive force being liable to damage the mechanism.

BRIEF SUMMARY OF THE INVENTION

An object of the present invention is to provide a throttle valve assembly of the type described in which the amount of play at the accelerator is reduced to a minimum, thereby causing no discomfort to the driver.

Another object of the present invention is to provide a throttle valve assembly of a simple construction which does not involve the problem of the inadequate return swing of the throttle valve.

Still another object of the present invention is to ensure smooth operation of the roller/cam mechanism so as to avoid unnecessary wearing thereof.

A further object of the present invention is to prevent the roller/cam slot mechanism from being subjected to an excessive force when the driver steps on the accelerator throughout its travel.

The present invention provides an improved throttle valve assembly of the type described, wherein means are provided between the throttle lever and the second, intermediate lever for adjusting the clearance existing between the cam slot and roller at the idle position of the throttle valve to below a tolerable value. By this provision, the play that ordinarily would arise at the accelerator is reduced, thereby removing any discomfort to the driver.

Preferably, the adjusting means may comprise an adjusting screw threadingly mounted on either the throttle lever or the intermediate lever and abutting against the other lever.

It is advantageous to place the adjusting screw obliquely with respect to the axis at the proximal end of the cam slot so that the lengthwise clearance and the crosswise clearance formed between the roller and cam slot are adjusted simultaneously by the adjusting screw.

Another feature of the present invention is that the throttle valve assembly is provided with means associated with the throttle lever for biassing the throttle valve toward the idle or closed position with a force sufficient to overcome the frictional force exerted on the throttle shaft. With this arrangement, the throttle valve can perform its return swing throughout the last angle corresponding to the above-mentioned lengthwise clearance of the cam slot, whereby any unnecessary play in the throttle linkage or accelerator is avoided.

The present invention also provides a feature in which a bearing bush made of a material having a low friction coefficient is provided between the roller and the roller shaft. This bearing bush permits reduction of the friction between the roller and the roller shaft and thus ensures smooth operation of the roller/cam slot mechanism. Preferably, the bearing bush may be made of polytetrafluoroethylene. Further, the roller may have an outer surface which is in the form of a section of a sphere. With such roller configuration, there is always a flatwise contact between the outer surface of the roller and the cam face of the cam slot even when the axis of the roller is inclined with respect to the lever in which the cam slot is formed, so that abnormal wearing of the cam slot is avoided.

A further feature of the present invention is that an abutment mechanism for limiting the wide-open position of the throttle lever is provided on the intermediate lever. With this arrangement, the force that is applied when the driver steps on the accelerator and is transferred through the throttle linkage to the throttle valve assembly at the wide-open position of the throttle valve is supported by the intermediate lever and, thus, the roller/cam slot assembly is not subjected to an excessive force, thereby avoiding damage to the roller/cam slot assembly.

DESCRIPTION OF THE PREFERRED EMBODIMENT

Figure 1:
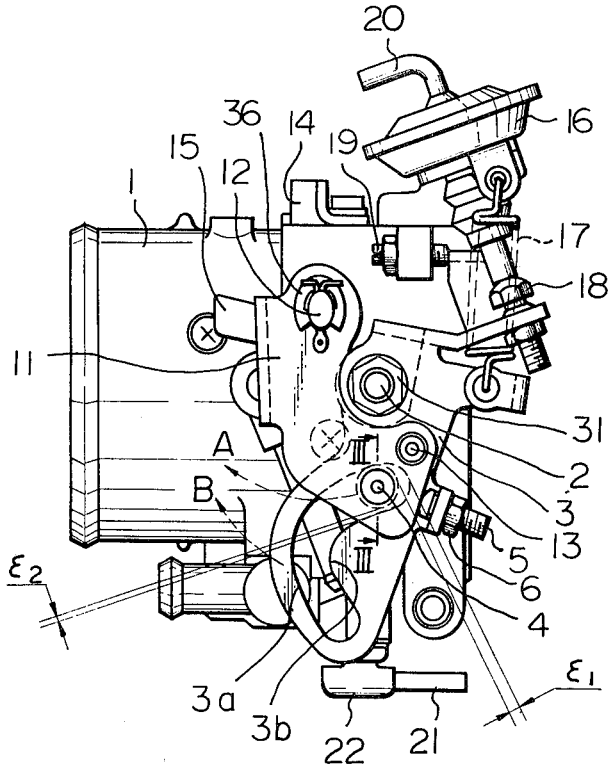
FIG. 1 is a front elevational view of an embodiment of the throttle valve assembly according to the present invention.
Figure 2:
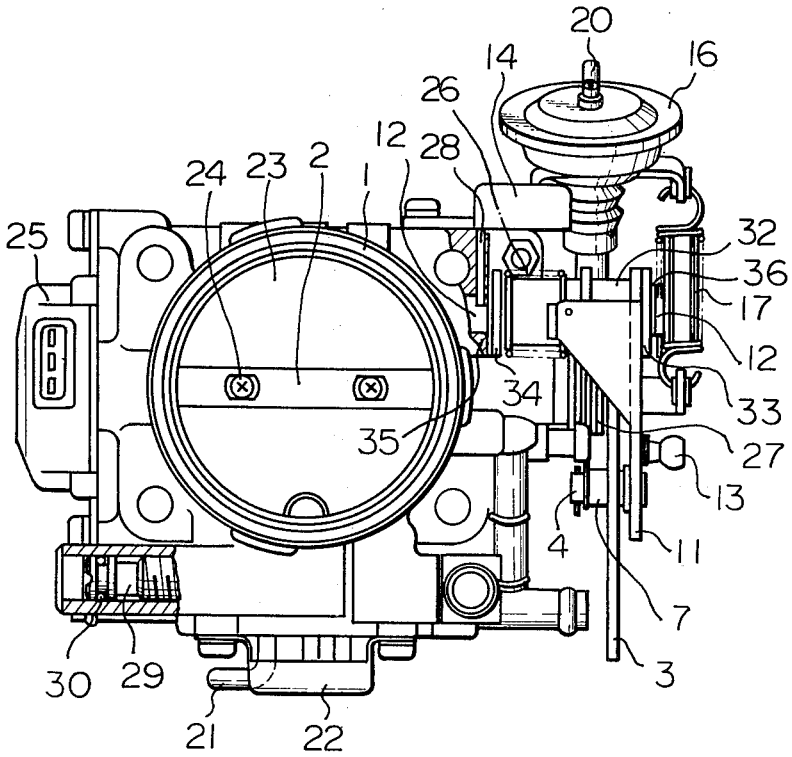
FIG. 2 is a side elevational view from the left of the embodiment of FIG. 1.

Referring now to the drawings, there is shown a throttle body 1 to which a throttle shaft 2 is journalled by means of two bearings (not shown). A throttle valve 23 is secured integrally to the throttle shaft 2 by a pair of bolts 24 so that the throttle valve 23 is opened or closed in response to the rotation of the shaft 2. A throttle lever 3 is press-fitted at one end to the throttle shaft and is fixed in position with a nut 31. With this arrangement, the throttle lever 3, throttle shaft 2, and throttle valve 23 are movable integrally with each other. The throttle lever 3 is provided with an arcuated cam slot having an outer cam face 3*a* and an inner cam face 3*b*.

Figure 3:
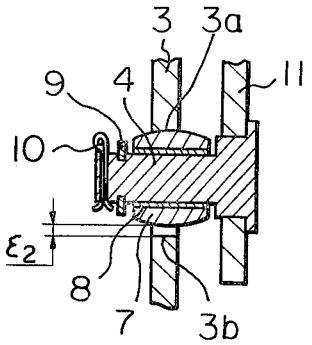
FIG. 3 is an enlarged longitudinal cross-sectional view along the line III—III of FIG. 1 illustrating in detail the parts located in the vicinity of the roller.

A pivot 12 is press-fitted into a hole of the throttle body 1 and is retained by a cotter pin 28. A second, intermediate lever 11 which has an integral collar 32 secured thereto by brazing, for example, is rotatably mounted on the pivot 12 by means of bearings (not shown) which are press-fitted within the collar 32. A circlip 36, a wave washer 35, and nylon washers 33 and 34 are mounted on the pivot 12 at the sides of the collar and lever assembly so as to limit the axial position of the intermediate lever 11. The intermediate lever 11 is provided with a ball joint 13 calked thereto for transmitting the movement of the accelerator (not shown) through the throttle linkage. The intermediate lever 11 is also provided with a roller shaft 4 fixed thereto. As will be most clearly understood from FIG. 3, a roller 7 is mounted rotatably on the roller shaft 4 through a film-like, thin-walled bearing bush 8 bonded to the inner cylindrical wall of the roller 7. The bearing bush 8 is made of a material having a low friction coefficient, such as polytetrafluoroethylene. Alternatively, the bush 8 may be made of a sintered material impregnated with a lubricating oil. The roller shaft 4 is provided with a circlip 9 and a hairpin clip 10 to prevent the roller 7 from slipping out of the shaft 4. The roller 7 is in contact with the cam face 3*a* of the cam slot formed in the throttle lever 3. The side surface of the roller 7 is shaped in the form of a section of a sphere to ensure that any edgewise contact between the edge of the cam face and the roller side surface is avoided even though the throttle lever 3 is inclined with respect to the axis of the roller 7. The roller 7 is made of stainless steel to prevent the formation of rust and has been subjected to a heat treatment, as has the throttle lever 3.

A side of the intermediate lever 11 is formed into a protuberance 15 to provide an abutment for a stop 14 secured to the throttle body 1 so that the wide-open position of the throttle valve 23 is limited when the accelerator is steped on throughout travel of the accelerator.

A tension coil spring 17 is mounted between a dashpot 16 secured to the throttle body 1 and the throttle lever 3, and a torsional coil spring 27 is provided between the throttle lever 3 and the throttle body 1. These springs have a spring force sufficient to return the throttle valve 23 against various frictional forces exerted thereon. Another torsional coil spring 26 is mounted between the throttle body 1 and the intermediate lever 11. This coil spring 26 has a spring force which is relatively small but is sufficient to overcome the friction between the pivot 12 and the intermediate lever 11.

An adjusting screw 5 is screwed into a threaded hole formed in a portion of the throttle lever 3 and is fixed with a nut 6 so that the head of the screw 5 is in contact with the intermediate lever 11. Thus, by releasing the nut 6 and turning the adjusting screw 5, the relative position of the intermediate lever with respect to the throttle lever may be varied.

A throttle-stop screw 19 is threadingly mounted on the throttle body and abuts against a portion of the throttle lever 3 so as to limit the idle position of the throttle valve 23.

A support 23 is bolted to the throttle body 1 to prevent a vacuum-sensing tube 21 from slipping out of the throttle body. 25 is a throttle-position sensor, 29 an adjusting screw for regulating the flow rate of the air bypassing the throttle valve, and 30 an O-ring mounted between the adjusting screw 29 and the throttle body so as to prevent air leakage therethrough and so as to grip the screw 29.

The operation of the throttle valve assembly described is as follows.

Figure 4:
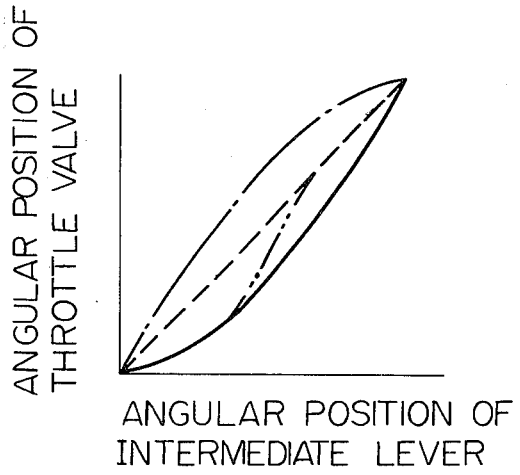
FIG. 4 is a graph illustrating various curves of the functional relationship between the angular positions of the throttle valve and the second lever obtained from various cam slot profiles.

The movement of the accelerator in accordance with the pressure applied thereto is transmitted through the throttle linkage to a ball joint 13, whereby the intermediate lever 11, together with the roller shaft 4 secured thereto and the roller 7 rotatably supported on the roller shaft 4, are turned about the pivot 12 in the direction indicated by the arrow A in FIG. 1. The movement of the roller 7 is transferred via the cam face 3*a* contacting the roller to the throttle lever 3 which, in turn, rotates about the throttle shaft 2 in the direction indicated by the arrow B in FIG. 1. As the throttle lever 3, the throttle shaft 2, and the throttle valve 23 are made integral, the angular displacement of the throttle valve 23 is identical with the angular displacement in the direction B of the throttle lever 3. The functional relationship between the angular displacement of the intermediate lever 11 and that of the throttle valve 23 is determined by the profile of the cam slot formed in the throttle lever 3. FIG. 4 illustrates some examples of the functional relationship obtained from various cam slot profiles. By selecting any one of the cam slot profiles, it is possible to comply with the driver's wishes.

In consideration of the dimensional variations that result during machining, the width of the cam slot formed in the throttle lever 3 has been made larger than the outer diameter of the roller 7. As a result, a crosswise clearance $\epsilon_2$ is formed between the cam slot and the roller 7, as shown in FIG. 1. For similar reasons, the length of the cam slot as measured along the longitudinal axis thereof is made greater than the travel of the roller 7, which travel takes place as the throttle valve 23 undergoes angular displacement from the idle position to a wide-open position and vice versa. Thus, a lengthwise clearance $\epsilon_1$ is formed, as shown in FIG. 1, between the proximal end of the cam slot and the roller 7 at the idle position of the throttle valve 23. This lengthwise clearance $\epsilon_1$ results in a play in the intermediate lever 11 and the accelerator.

According to the embodiment, this play can be reduced to below the tolerable amount by rotating the adjusting screw 5 mounted on the throttle lever 3 so as to bring the head of the screw 5 into contact with the intermediate lever 11 and by adjusting the relative position of the intermediate lever 11 with respect to the throttle lever 3. In this manner, any possible discomfort to the driver can be avoided.

As the driver releases the accelerator from a pressed-down position during running of the vehicle, the intermediate lever 11 swings counterclockwise, as viewed in FIG. 1, allowing the throttle lever 3 to return to the idle position. If the throttle shaft 2 is not biassed toward the return position by an adequate spring force, the throttle lever 3 will tend to stay in its present position as the intermediate lever 11 swings toward the return position, so that the roller 7 disengages from the cam face 3*a* and moves away therefrom in a closing direction at an angle corresponding to the crosswise clearance $\epsilon_2$ until it comes in contact with the opposite cam face 3*b* and turns the throttle valve 23 toward the idle position, resulting in inadequate return of the throttle valve 23. According to the present invention, this disadvantage is overcome by the tension coil spring 17 and the torsional coil spring 27 associated with the throttle lever 3. These springs provide a spring force sufficient to move the throttle valve 23 toward the idle position against various frictional forces exerted on the throttle shaft 2. With this arrangement, the roller 7 is held in contact with the cam face 3*a* of the cam slot during both the opening and closing movements of the throttle shaft 2, thereby avoiding the problem of inadequate return of the throttle valve 23.

Further, the roller 7 is mounted on the roller shaft 4 by means of a thin-walled bearing bush 8 which is bonded to the inner bore of the roller and which is made of a material having a low friction coefficient. With this construction, the frictional force at the inner surface of the roller 7 becomes smaller than that at the outer surface, whereby smooth rotation of the roller is ensured and any undesirable wearing of the roller 7 and the cam face 3*a* is avoided.

Further, as the side surface of the roller 7 is shaped in the form of a section of a sphere, any local contact between the edge of the cam face and the roller side surface is avoided even though the throttle lever becomes inclined with respect to the axis of the roller 7. This prevents wearing of the edge of the cam face.

In the prior throttle valve assembly, the wide-open position of the throttle valve 23 is limited by a projection provided on a portion of the throttle lever 3 and an associated stop secured to the throttle body 1. With this arrangement, however, the excessive force applied at the wide-open position of the throttle valve when the accelerator is stepped on is transferred to the roller 7 and the cam face 3*a* and is liable to cause deformation and wearing of the parts of the roller/cam slot assembly. According to the present invention, the wide-open position of the throttle valve is limited by the protuberance 15 which is provided on the intermediate lever 11 and which abuts against the stop 14 secured to the throttle body 1. With this construction, neither the roller 7, the cam face 3*a*, nor the throttle lever 3 is subjected to such excessive force.

In the illustrated embodiment, the roller 7 is provided on the intermediate lever 11 and the cam slot is formed in the throttle lever 3. However, it will be apparent that the roller 7 and the cam slot may be arranged vice versa.

Further, the thin-walled bearing bush 8 with a low friction coefficient may be bonded to the roller shaft 4 instead of to the roller 7.

In the embodiment described, the bearing bush 8 is fixed by bonding of press-fitting. However, it should be understood that the bearing bush 8 may be formed, by means of a coating technique, on the inner surface of the roller 7 or on the outer surface of the roller shaft 4 or may be bonded by means of any other suitable technique.

We claim:

1. An improved throttle valve assembly of the type which includes a throttle body having an intake passage therein, a throttle shaft journalled on said throttle body across said intake passage, a throttle lever secured to said throttle shaft, a throttle valve mounted on said throttle shaft for regulating the flow rate of the intake air flowing through said passage, and a second, intermediate lever pivoted on said throttle body and adapted to be moved via a throttle linkage by an accelerator, one of said throttle lever and second lever having an arcuated cam slot engaging with a roller mounted rotatably on the other lever for interconnecting said levers with each other, and in which the cam profile of said cam slot is arranged so that when the accelerator is stepped on, the angular position of the throttle valve varies in response to the travel of the accelerator according to a predetermined functional relationship, wherein the improvement comprises: means disposed between sai throttle lever and second lever for adjusting a clearance existing between said cam slot and roller at the idle position of said throttle valve to below the tolerable value.

2. An improved throttle valve assembly as claimed in claim 1, wherein said adjusting means comprises an adjusting screw threadingly mounted on one of said levers and abutting against the other lever.

3. An improved throttle valve assembly as claimed in claim 2, wherein the longitudinal axis of said adjusting screw is positioned obliquely with respect to the axis of said cam slot at the proximal end thereof so that both the lengthwise clearance and the crosswise clearance formed between said cam slot and the roller are adjusted simultaneously by said adjusting screw.

4. An improved throttle valve assembly as claimed in claim 3, further comprising means associated with said throttle lever for biassing said throttle valve toward the idle position thereof with a force sufficient to overcome the frictional force exerted on said throttle shaft.

5. An improved throttle valve assembly as claimed in claim 4, wherein said roller is mounted rotatably on a roller shaft secured to said other lever and wherein a bearing bush made of a material having a low friction coefficient is provided between said roller and roller shaft.

6. An improved throttle valve assembly as claimed in claim 5, wherein said material is polytetrafluoroethylene.

7. An improved throttle valve assembly as claimed in claim 6, wherein said roller has an outer surface in the form of a section of a sphere.

8. An improved throttle valve assembly as claimed in claim 7, further comprising means associated with said intermediate lever for limiting the wide-open position of said throttle valve.

* * * * *